United States Patent [19]

Rodrigues et al.

[11] Patent Number: 5,074,927

[45] Date of Patent: Dec. 24, 1991

[54] PROCESS FOR THE PRODUCTION OF FERRITIC STAINLESS STEEL

[75] Inventors: Valentim A. Rodrigues; Ronaldo C. Ribeiro da Silva, both of Timóteo; Ronaldo A. N. Marques Barbosa, Belo Horizonte; José Nunes de Carvalho; José N. da Silva, both of Timóteo, all of Brazil

[73] Assignee: Cia. Acos Especiais Itabira - Acesita, Minas Gerais, Brazil

[21] Appl. No.: 570,829

[22] Filed: Aug. 22, 1990

[30] Foreign Application Priority Data

Aug. 22, 1989 [BR] Brazil ..... PI8904272
May 25, 1990 [BR] Brazil ..... PI9002535

[51] Int. Cl.[5] ..... C21D 8/00
[52] U.S. Cl. ..... 148/12 EA; 148/2
[58] Field of Search ..... 148/12 EA, 2

[56] References Cited

U.S. PATENT DOCUMENTS 4,374,683 2/1983 Koike et al. ..... 148/12 EA

*Primary Examiner*—Deborah Yee
*Attorney, Agent, or Firm*—Beveridge, DeGrandi & Weilacher

[57] ABSTRACT

A process for the production of strips and plates of ferritic stainless steel containing Nb, which are hot rolled and annealed continuously so as to obtain a metallurgical structure such that, after conventional cold rolling, the resulting product has improved characteristics of medium and deep stamping characteristics. The last pass of the rough rolling stage is effected at a temperature between 900° and 950° C. with reductions of 35 to 50%. In the last pass of the finishing mill operates at temperatures lower than 900° C. and a deformation of greater than 35%. The resulting coil is then annealed in a single heat treatment in a continuous furnace at temperatures between 900° and 1100° C.

10 Claims, 6 Drawing Sheets

PROCESS FOR THE PRODUCTION OF FERRITIC STAINLESS STEEL

The present invention refers to a process and a system for the production of strips and plates of ferritic stainless steel containing Nb, which are hot rolled and annealed in a single heat treatment, the coils of ferritic stainless steel obtained thereby having excellent medium and deep stamping characteristics as well as excellent streaking characteristics, after conventional cold rolling.

BACKGROUND OF THE INVENTION

A process for hot rolling plates of ferritic stainless steel containing Nb known in the art is described in U.S. Pat. No. 4,374,683 which discloses a final rolling temperature in the finishing mill of 850° C. or less, and the annealing of the resulting coil at temperatures of from 950° to 1050° C. However, the rolling process defined in the above-mentioned patent can be only used for steels having low carbon content, that is to say, not higher than 0.020% by weight, whereby it cannot be used for steels that are more difficult to roll.

Brazilian patents PI 8100131 and PI 8107666 describe processes for the production of strips which include adding Al to the ferritic stainless steel, such processes having the disadvantage of a double heat treatment of the hot rolled coils being necessary in order to avoid the so-called gold-powder defect that appears in cold rolled strips manufactured conventionally from ferritic stainless steel containing aluminum In the processes described in such Brazilian patents, the strips are hot rolled at a temperature higher than 900° C. and are subjected to a first heat treatment at temperatures of from 700° to 1100° C., followed by a second heat treatment at temperatures of from 700° to 900° C. for diffusing the chromium, after which they are cooled down to a temperature lower than 200° C.

The second heat treatment is carried out in order to allow the chromium to diffuse into the regions that become poor in this element due to the precipitation of chromium carbonitride during the initial heating up to temperatures of 1100° C. If this treatment is not effected, a deterioration of the corrosion resistance will occur, which causes the gold-powder defect in the strips after the cold rolling. The above-mentioned processes have the further disadvantage that it is necessary to control the cooling temperature and that the lines of continuous annealing of hot rolled ferritic stainless steel strips must be especially designed for causing diffusion of the chrome in order to avoid the gold-powder defect. In such special lines, in addition to the furnaces and the cooling unit existing in conventional lines, one more furnace and one more cooling unit must be installed.

SUMMARY OF THE INVENTION

The object of the present invention is to overcome the above mentioned disadvantages and provide cold rolled strips and plates of ferritic stainless steel having a high stamping capacity, measured by the Lankford coefficient (R value) as higher that 1.1, and a low degree of streaking (lower than 1, on a scale varying from 0 to 5).

According to the present invention a process for the production of ferritic stainless steel containing niobium comprises the steps of casting ingots, passing the ingot material through a multi-pass rough rolling mill to produce an intermediate strip and passing said intermediate strip through a multi-pass finishing mill, followed by continuous annealing and cold rolling, wherein, in the last passes of said rough rolling mill, the temperature ranges from 900° to 950° C., and the reduction obtained is of from 35 to 50%, and, in the last pass of said finishing mill, the temperature is lower than 900° C. and the deformation is higher than 35%. The process of the present invention makes it possible to establish ideal processing conditions during the rough rolling of ferritic stainless steel containing Nb and up to 0.06% of C, by providing the ideal grain size for the final hot rolled annealed coils, as well as the ideal reduction in the last roll pass of the finishing rolling mill. Moreover, the present process brings about the possibility of using a single heat treatment step after the hot rolling, so as to avoid the gold powder defect, besides the utilization of conventional continuous annealing lines.

DETAILED DESCRIPTION OF THE INVENTION

In the present process, stainless steels containing Nb are used, which in general have the following chemical composition:

from 0.40 to 1.00%: Nb
up to 0.06%: C
from 15 to 20%: Cr
up to 0.025%: N
the balance being Fe and the residual elements generally found in stainless steels.

Figure 1:
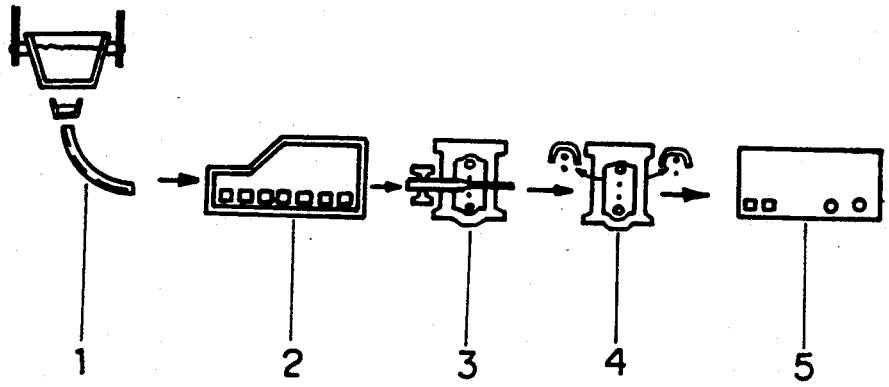
FIG. 1 is a schematic view of the system for production of ferritic stainless steel according to the present invention.

The process for producing ferritic stainless steel in accordance with the present invention is described with reference to FIG. 1.

Figure 2:
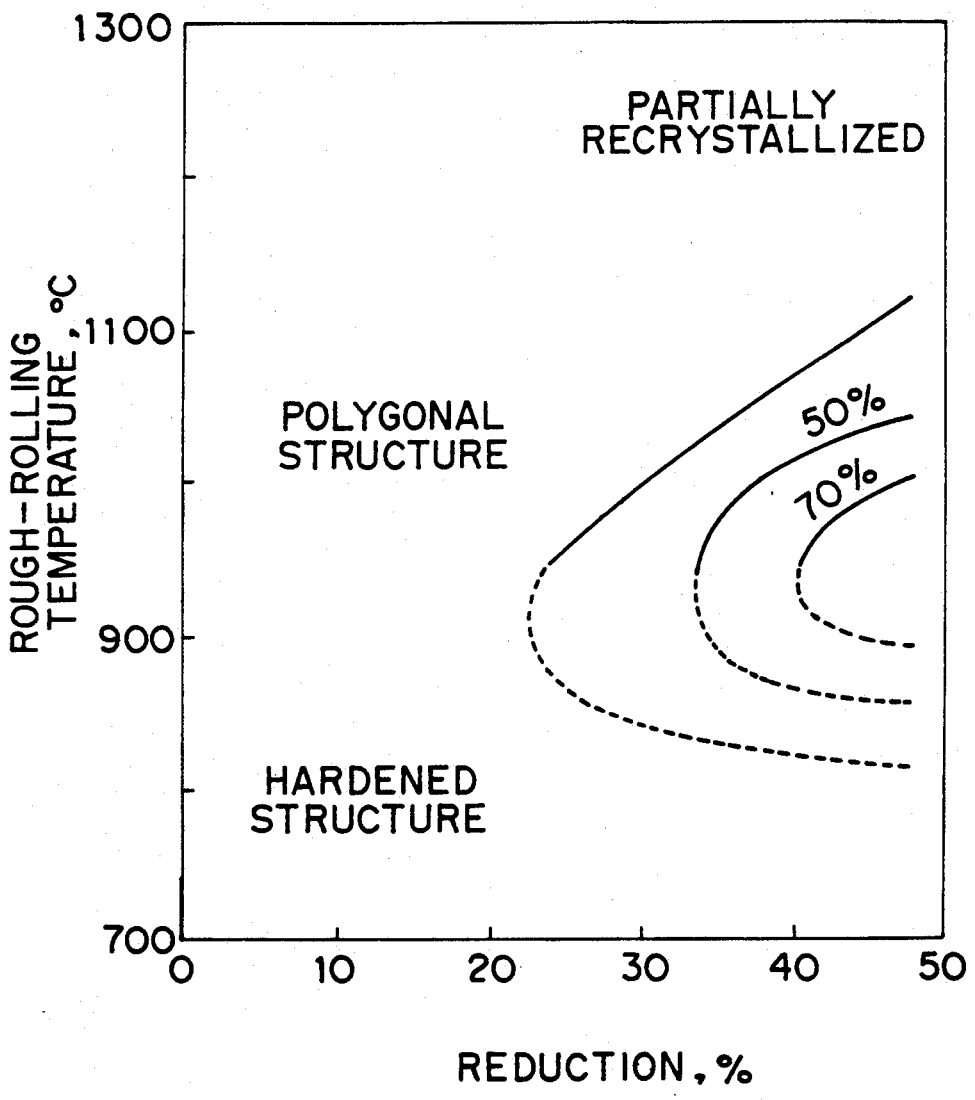
FIG. 2 is a graph showing the relationship between the rough-rolling temperature and the recrystallization.
Figure 3:
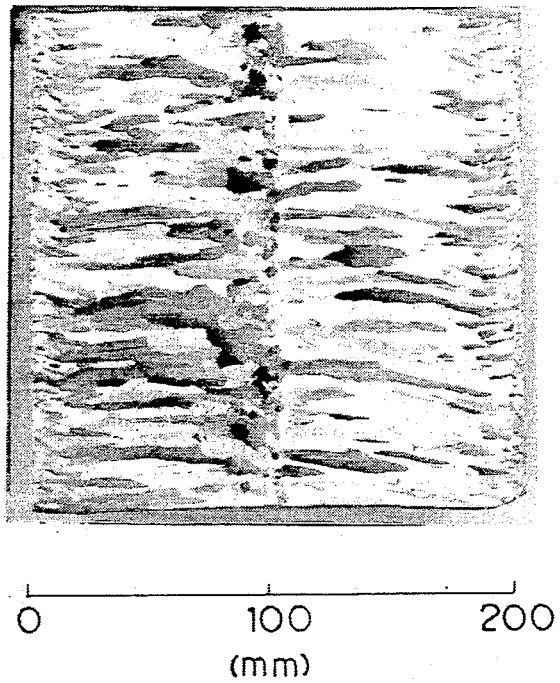
FIGS. 3 and 4 show, respectively, the columnar structure of the ingot-molding plate and the metallographic structure of the plate after the rough rolling.
Figure 4:
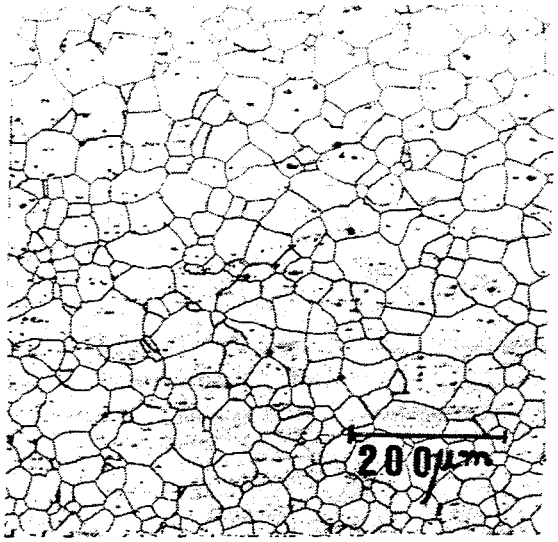

The ferritic stainless steel plate produced in the ingot-casting equipment 1 is heated in a reheating furnace 2 up to a temperature above 950° C., preferably a temperature higher than 1050° C. The plate is then processed in a rough rolling mill 3 in such a manner than in the last passes it will indergo reductions ranging from 35 to 50%, preferably 40%, at a temperature in the range of 900°-950° C. This condition is obtained through a processing at a reduced deformation speed, since in this way, during the rolling, there will be a temperature drop which provides the conditions for obtaining the above specified temperatures. FIG. 2 shows the relationship between the rough rolling temperature and the reduction in so that re-crystallization can occur. Recrystallization of the material is observed to begin from 25% reduction, at a temperature of 950° C. When the temperature giving a reduction of 40% is reached, the recrystallization fraction is 70%. Under such conditions, the rough casting structure resulting from the continuous ingot casting process is totally broken up and a totally new recrystallized and homogeneous structure is obtained, having a grain size ranging from 60 to 80 μm. FIGS. 3 and 4 respectimely show the columnar structure of the cast ingot plate and the metallographic structure of the plate after rough rolling. This process does not depend upon the use of a magnetic stirrer for breaking the columnar grain in the vein of the continuously cast ingot 1.

Figure 5:
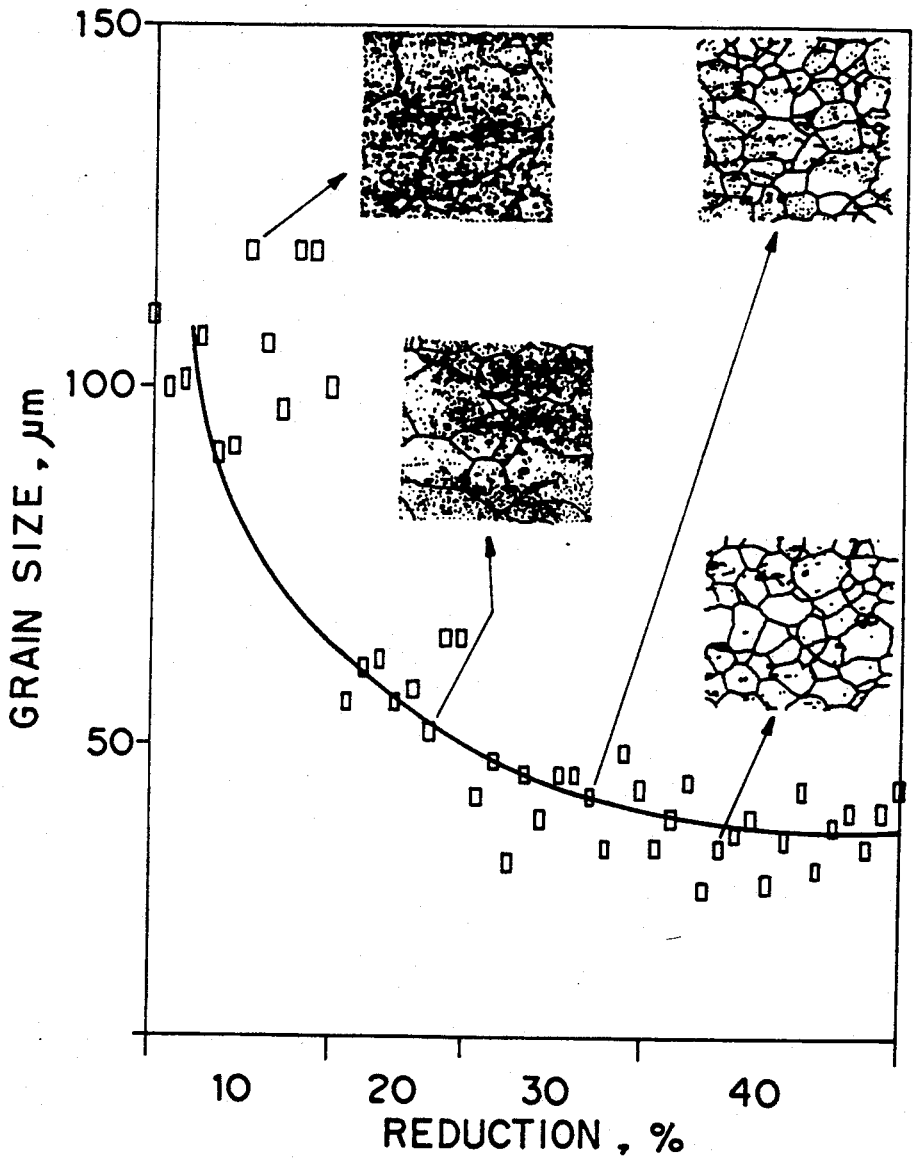
FIG. 5 is a graph of the grain size as a function of the deformation.
Figure 6:
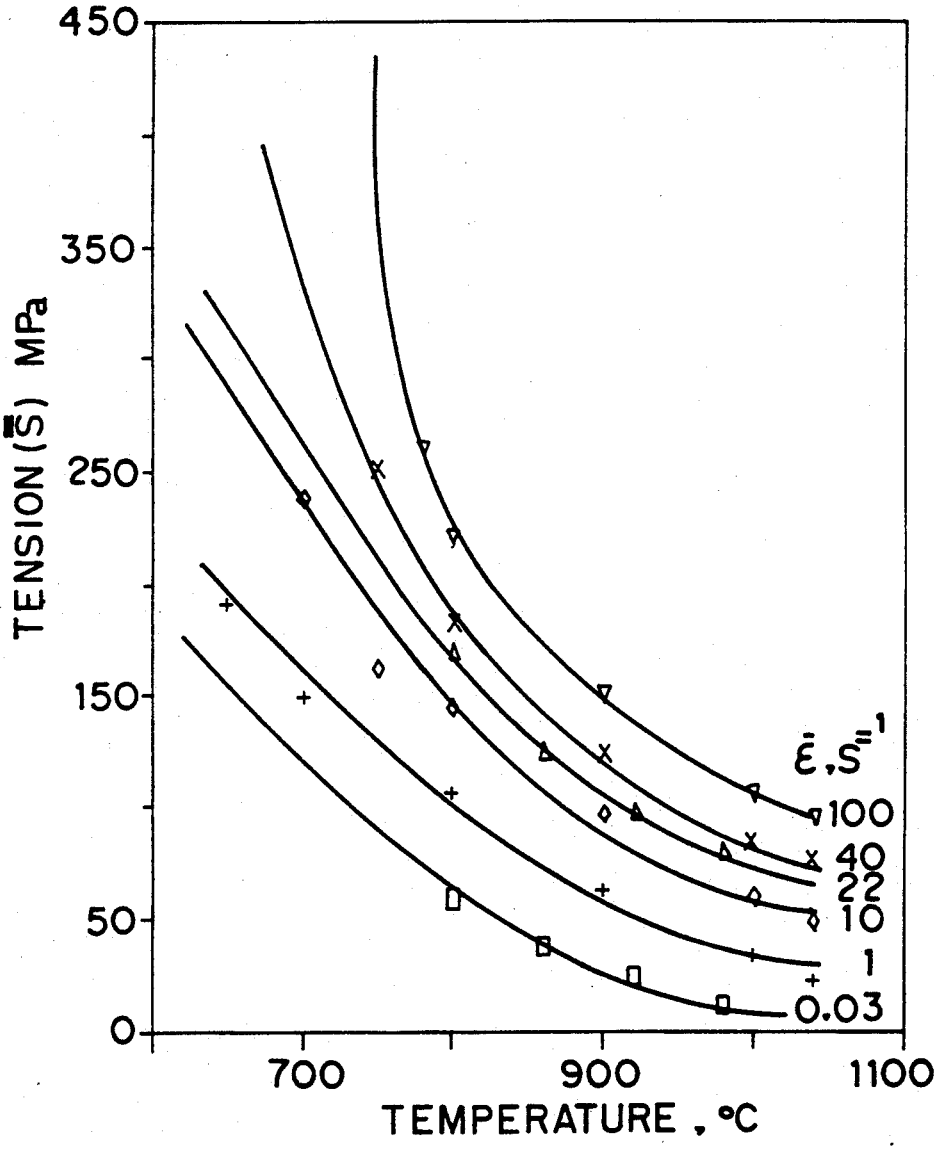
FIG. 6 is a graph showing the tension variation as a function of the temperature at several deformation speeds.

The material leaving the rough rolling mill 3 enters a finishing mill 4 which is capable of operating at a deformation speed less than 40 $s^{-1}$ at a temperature of from 800° to 850° C. During the processing in this mill, the material undergoes a temperature drop; and for obtaining the ideal conditions, the temperature in the last pass should be lower than 900° C., preferably lower than 750° C., and a deformation greater than 35% should be obtained. In this way a grain size ranging from 30 to 50 μm, preferably lesser than 40 μm, is obtained after annealing of the strip. FIG. 5 shows the variation of the grain size as a function of the deformation, and it can be seen that the decrease in grain size tends to remain constant at the level of 40%. Therefore, in order to obtain a minimum grain size, the decrease should be greater than 40% and the temperature should be lower than 750° C. Such a condition is only possible by using a mill 4 which can be operated at a low deformation speed, that is, lower than $40s^{-1}$. This is due to the fact that, since the mechanical strength of the material is very sensitive to the variation of the deformation rate when said material is processed at low temperatures and high deformation rates, the rolling loads will reach high values and thus make processing impossible. FIG. 6 shows the variation inaverage tension in the plane state ($\bar{s}$) as a function of the temperature at several deformation rates.

After the processing described above, the hot rolled coil is cooled down to room temperature and presents a hardened structure having a high deformation energy. After the coil has been cooled, it is annealed in a conventional continuous annealing line 5. The purpose of this annealing is to supply heat energy for activating the total crystallization of the deformed structure, which together with the selected deformation, will produce refined grains.

Figure 7:
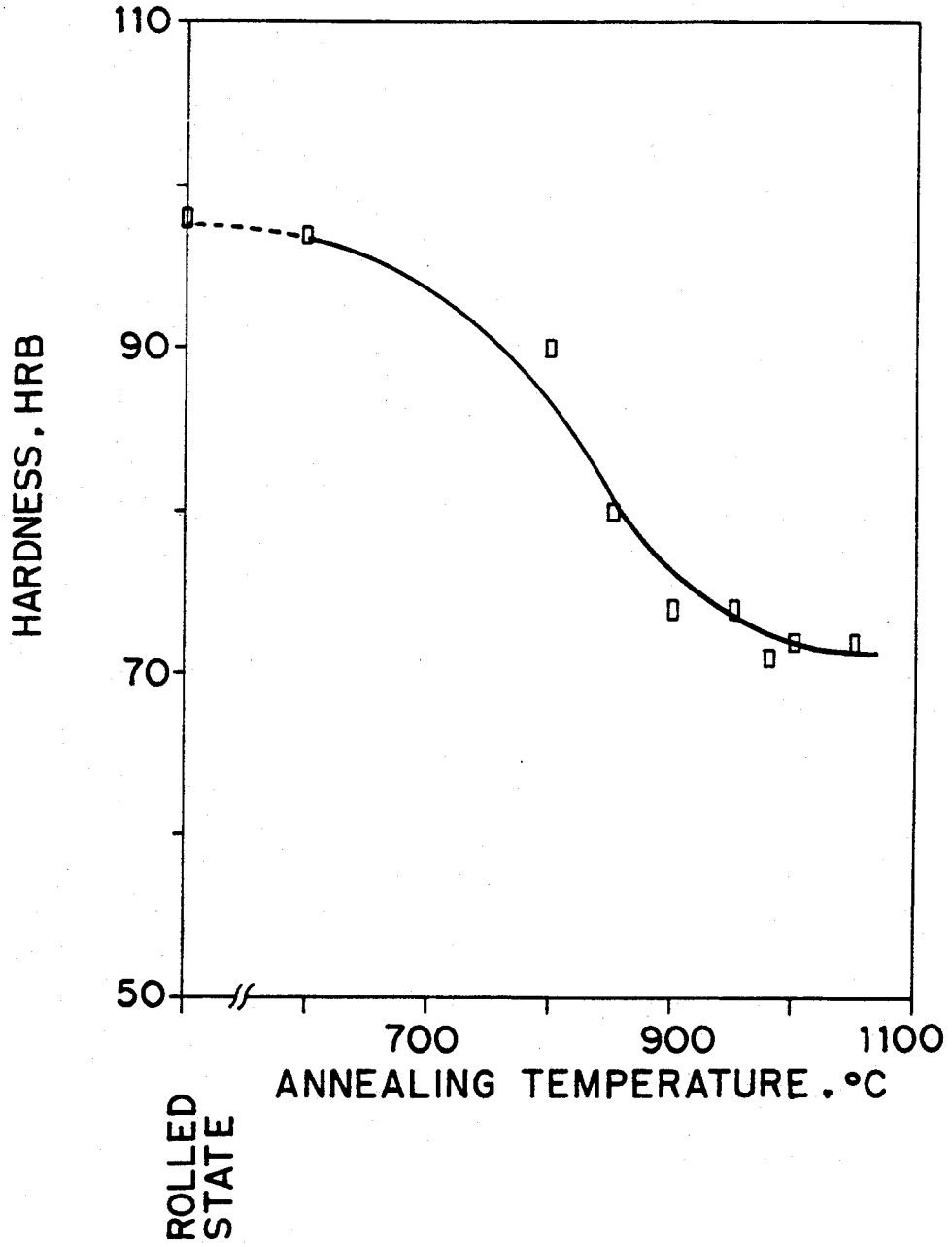
FIG. 7 is a graph showing the relationship of the hardness and the annealing temperature.

The annealing temperature should be between 900° and 1100° C., a total recrystallization being maintained in this range without increasing the grain size. FIG. 7 shows the variation of hardness in relation to the annealing temperature for a material processed in accordance with the process of the invention. As it can be promptly seen, from 900° C. onwards the hardness reaches the level representative of the recrystallized material (70 to 78 HRB). The steel processed in such conditions will be totally recrystallized and will present a grain size ranging from 30 to 40 μm. The refinement obtained in the structure of the material, that is, the grain size smaller than 40 μm, after hot annealing of the coil, is the factor that determines that the material is ready to be cold rolled so as to obtain high R values and a low degree of streaking.

The resulting strips are then cold rolled in accordance with conventional practice.

For the purpose of illustrating the process of the present invention, the results obtained with the production of 60 tons of ferritic stainless steel containing niobium are presented below.

TABLE 1

| | Chemical composition given in weight percentages | | | | | | | |
|---|---|---|---|---|---|---|---|---|
| Run | C | Si | Mn | P | S | Cr | Nb | N |
| a | 0.021 | 0.49 | 0.27 | 0.028 | 0.003 | 16.70 | 0.44 | 0.015 |
| b | 0.034 | 0.27 | 0.28 | 0.029 | 0.005 | 16.66 | 0.49 | 0.018 |

The plates produced were reheated up to 1050° C., rolled in the rough rolling mill 3 with a reduction greater than 40% in the last pass and temperatures between 900° and 920° C. The plates thus processed entered the Steckel finishing mill 4 at temperatures in the range of 800°–850° C. In the last pass, they were rolled at temperatures lower than 750° C. showing reductions greater than 40% and deformation rates less than $40s^{-1}$. The hot rolled coils were then annealed at temperatures in the range of 930° to 980° C. incontinuous annealing lines for stainless steel and, finally, subjected to cold rolling and final annealing.

As a result, trips and plates of ferritic stainless steel containing niobium have been obtained without presenting the gold powder defect and with excellent stamping and streaking properties, as shown in Table II.

TABLE II

| | Stamping and streaking coefficients | |
|---|---|---|
| Run | Stamping (R value) | Streaking |
| a | 1.3 | 0.0 |
| b | 1.2 | 0.5 |

(*) Streaking is measured on a scale from 0 to 5, the lowest quality being represented by 5.

Table III shows further characteristics of one of the steels that may be produced in accordance with the invention.

TABLE III

| | Data relating to strength and stamping characteristics of a 430 + Nb steel. | | | | |
|---|---|---|---|---|---|
| Steel | Yield Point (MPa) | Tensile Strength | Elongation (%) | Hardness (HRB) | ERICHSEN (mm) |
| 430 + Nb | 279 | 459 | 31 | 75 | 9.4 |

We claim:

1. A process for the production of ferritic stainless steel containing niobium comprising the steps of casting ingots, passing the ingot material through a multi-pass rough rolling mill to produce an intermediate strip and passing said intermediate strip through a multi-pass finishing mill, followed by continuous annealing and cold rolling, wherein, in the last passes of said rough rolling mill, the temperature ranges from 900° to 950° C., and the reduction obtained is of from 35 to 50% and that, in the last pass of said finishing mill, the temperature is lower than 900° C. and the deformation is higher than 35%.

2. A process in accordance with claim 1, wherein the reduction in the last pass of said rough rolling mill is of 40%.

3. A process in accordance with claim 1, wherein, in the last pass of said finishing mill, the temperature is lower than 750° C. and the deformation is of about 40%.

4. A process in accordance with claim 3, wherein the temperature in the last pass of said finishing mill is of 730° C.

5. A process in accordance with claim 3, wherein the resulting grain size after said finishing mill varies from 30 to 50 μm.

6. A process in accordance with claim 5, wherein the resulting grain size after said finishing mill is of about 30um.

7. A process in accordance with claim 1, wherein said continuous annealing comprises a single heat treatment at temperatures ranging from 900° to 1100° C.

8. A process in accordance with claim 7, wherein the annealing temperature ranges from 900° to 980° C.

9. A process in accordance with claim 8, wherein the annealing temperature is of 950° C.

10. A process according to claim 1, wherein the steel contains from 0.40 to 1.00% of Nb, up to 0.06% of C, from 15 to 20% of Cr, up to 0.025% of N, the balance being iron and the residual elements usually found in stainless steels.

* * * * *